US008068627B2

(12) United States Patent
Zhang et al.

(10) Patent No.: US 8,068,627 B2
(45) Date of Patent: Nov. 29, 2011

(54) SYSTEM FOR AUTOMATIC RECEPTION ENHANCEMENT OF HEARING ASSISTANCE DEVICES

(75) Inventors: Tao Zhang, Eden Prairie, MN (US); William S. Woods, Berkeley, CA (US); Timothy Daniel Trine, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 1294 days.

(21) Appl. No.: 11/686,275

(22) Filed: Mar. 14, 2007

(65) Prior Publication Data

US 2007/0217629 A1 Sep. 20, 2007

Related U.S. Application Data

(60) Provisional application No. 60/743,481, filed on Mar. 14, 2006.

(51) Int. Cl.
*H04R 25/00* (2006.01)

(52) U.S. Cl. ..... 381/313; 381/317

(58) Field of Classification Search ..... 381/92, 381/94.1, 94.7, 26, 122, 312, 313, 328, 355–358
See application file for complete search history.

(56) References Cited

U.S. PATENT DOCUMENTS 6,389,142 B1 * 5/2002 Hagen et al. ..... 381/313
6,522,756 B1 * 2/2003 Maisano et al. ..... 381/92
6,718,301 B1 4/2004 Woods
6,782,361 B1 8/2004 El-Maleh et al.
6,912,289 B2 6/2005 Vonlanthen et al.
7,149,320 B2 12/2006 Haykin et al.
7,158,931 B2 1/2007 Allegro
7,349,549 B2 3/2008 Bachler et al.
7,383,178 B2 6/2008 Visser et al.
7,454,331 B2 11/2008 Vinton et al.
7,986,790 B2 7/2011 Zhang et al.
(Continued)

FOREIGN PATENT DOCUMENTS

AU 2005100274 A4 6/2005
(Continued)

OTHER PUBLICATIONS

Preves, David A., "Field Trial Evaluations of a Switched Directional/Omnidirectional In-the-Ear Hearing Instrument", *Journal of the American Academy of Audiology*, 10(5), (May 1999),273-283.

(Continued)

*Primary Examiner* — Davetta W Goins
*Assistant Examiner* — Phylesha Dabney
(74) *Attorney, Agent, or Firm* — Schwegman, Lundberg & Woessner, P.A.

(57) ABSTRACT

Method and apparatus for automatic reception enhancement of hearing assistance devices. The present subject matter relates to methods and apparatus for automatic reception enhancement in hearing assistance devices. It provides a power estimation scheme that is reliable against both steady and transient input. It provides a TSM estimation scheme that is effective and efficient both in terms of storage size and computational efficiency. The embodiments employing a decision tree provide a weight factor between the omnidirectional and compensated directional signal. The resulting decision logic improves speech intelligibility when talking under noisy conditions. The decision logic also improves listening comfort when exposed to noise. Additional method and apparatus can be found in the specification and as provided by the attached claims and their equivalents.

20 Claims, 4 Drawing Sheets

U.S. PATENT DOCUMENTS

| | | | |
|---|---|---|---|
| 2002/0191799 | A1 | 12/2002 | Nordqvist et al. |
| 2002/0191804 | A1 | 12/2002 | Luo et al. |
| 2003/0112988 | A1 | 6/2003 | Naylor |
| 2003/0144838 | A1 | 7/2003 | Allegro |
| 2004/0015352 | A1 | 1/2004 | Ramakrishnan et al. |
| 2004/0190739 | A1 | 9/2004 | Bachler et al. |
| 2005/0069162 | A1 | 3/2005 | Haykin et al. |
| 2005/0129262 | A1 | 6/2005 | Dillon et al. |
| 2007/0217620 | A1 | 9/2007 | Zhang et al. |
| 2007/0219784 | A1 | 9/2007 | Zhang et al. |
| 2007/0299671 | A1 | 12/2007 | McLachlan et al. |
| 2008/0019547 | A1 | 1/2008 | Baechler |
| 2008/0037798 | A1 | 2/2008 | Baechler et al. |
| 2008/0107296 | A1 | 5/2008 | Bachler et al. |

FOREIGN PATENT DOCUMENTS

| | | | |
|---|---|---|---|
| AU | 2002224722 | B2 | 4/2008 |
| CA | 2439427 | | 4/2002 |
| EP | 0396831 | A2 | 11/1990 |
| EP | 0335542 | B1 | 12/1994 |
| EP | 1256258 | B1 | 3/2005 |
| WO | WO-0176321 | A1 | 10/2001 |
| WO | WO-0232208 | A2 | 4/2002 |

OTHER PUBLICATIONS

"U.S. Appl. No. 11/276,793, Final Office Action mailed Aug. 12, 2010", 27 pgs.
"U.S. Appl. No. 11/276,793, Non Final Office Action mailed Feb. 9, 2011", 25 pgs.
"U.S. Appl. No. 11/276,793, Non-Final Office Action mailed Jan. 19, 2010", 23 pgs.
"U.S. Appl. No. 11/276,793, Non-Final Office Action mailed May 12, 2009", 20 pgs.
"U.S. Appl. No. 11/276,793, Response filed Jan. 12, 2011 to Final Office Action mailed Aug. 12, 2010", 11 pgs.
"U.S. Appl. No. 11/276,793, Response filed Jun. 21, 2010 to Non Final Office Action mailed Jan. 19, 2010", 10 pgs.
"U.S. Appl. No. 11/276,793, Response filed Jun. 21, 2010 to Non Final Office Action mailed Jan. 19, 2010", 10 pgs.
"U.S. Appl. No. 11/276,793, Response filed Nov. 11, 2009 to Non Final Office Action mailed May 12, 2009", 16 pgs.
"U.S. Appl. No. 11/276,795, Advisory Action mailed Jan. 12, 2010", 13 pgs.
"U.S. Appl. No. 11/276,795, Decision on Pre-Appeal Brief Request mailed Apr. 14, 2010", 2 pgs.
"U.S. Appl. No. 11/276,795, Examiner Interview Summary filed Mar. 11, 2011", 1 pg.
"U.S. Appl. No. 11/276,795, Examiner Interview Summary mailed Feb. 9, 2011", 3 pgs.
"U.S. Appl. No. 11/276,795, Final Office Action mailed Oct. 14, 2009", 15 pgs.
"U.S. Appl. No. 11/276,795, Final Office Action mailed Nov. 24, 2010", 17 pgs.
"U.S. Appl. No. 11/276,795, Non Final Office Action mailed May 7, 2009", 13 pgs.
"U.S. Appl. No. 11/276,795, Non-Final Office Action mailed May 27, 2010", 14 pgs.
"U.S. Appl. No. 11/276,795, Notice of Allowance mailed Mar. 18, 2011", 12 pgs.
"U.S. Appl. No. 11/276,795, Pre-Appeal Brief Request mailed Feb. 16, 2010", 4 pgs.
"U.S. Appl. No. 11/276,795, Response filed Jan. 24, 2011 to Final Office Action mailed Nov. 24, 2010", 11 pgs.
"U.S. Appl. No. 11/276,795, Response filed Sep. 8, 2009 to Non-Final Office Action mailed May 7, 2009", 10 pgs.
"U.S. Appl. No. 11/276,795, Response filed Sep. 28, 2010 to Non Final Office Action mailed May 27, 2010", 6 pgs.
"U.S. Appl. No. 11/276,795, Response filed Dec. 14, 2009 to Final Office Action mailed Oct. 14, 2009", 10 pgs.
"European Application No. 07250920.1, Extended European Search Report mailed May 11, 2007", 6 pgs.
El-Maleh, Khaled Helmi, "Classification-Based Techniques for Digital Coding of Speech-plus-Noise", Department of Electrical & Computer Engineering, McGill University, Montreal, Canada, A thesis submitted to McGill University in partial fulfillment of the requirements for the degree of Doctor of Philosophy., (Jan. 2004), 152 pgs.
"U.S. Appl. No. 11/276,793, Response filed Aug. 9, 2011 to Non-Final Office Action mailed Feb. 9, 2011", 14 pgs.

* cited by examiner

SYSTEM FOR AUTOMATIC RECEPTION ENHANCEMENT OF HEARING ASSISTANCE DEVICES

RELATED APPLICATION

This patent application claims the benefit, under 35 U.S.C. Section 119(e), of U.S. Provisional Patent Application Ser. No. 60/743,481, filed on Mar. 14, 2006, which is incorporated herein by reference.

TECHNICAL FIELD

This disclosure relates to hearing assistance devices, and in particular to method and apparatus for automatic reception enhancement of hearing assistance devices.

BACKGROUND

Patients who are hard of hearing have many options for hearing assistance devices. One such device is a hearing aid. Hearing aids may be worn on-the-ear, in-the-ear, and completely in-the-canal. Hearing aids can help restore hearing, but they can also amplify unwanted sound which is bothersome and sometimes ineffective for the wearer.

Many attempts have been made to provide different hearing modes for hearing assistance devices. For example, some devices can be switched between directional and omnidirectional receiving modes. A user is more likely to rely on directional reception when in a room full of sound sources. Directional reception assists the user in hearing an intended subject, instead of unwanted sounds from other sources.

However, even switched devices can leave a user without a reliable improvement of hearing. For example, conditions can change faster than a user can switch modes. Or conditions can change without the user considering a change of modes.

What is needed in the art is an improved system for changing modes of hearing assistance devices to improve the quality of sound and signal to noise ratio received by those devices. The system should be highly programmable to allow a user to have a device tailored to meet the user's needs and to accommodate the user's lifestyle. The system should provide intelligent and automatic switching based on programmed settings and should provide reliable performance for changing conditions.

SUMMARY

The above-mentioned problems and others not expressly discussed herein are addressed by the present subject matter and will be understood by reading and studying this specification.

The present subject matter provides systems, devices and methods for automatic reception enhancement of hearing assistance devices. Omnidirectional and directional microphone levels are compared, and are mixed based on their relative signal strength and the nature of the sound received.

Some examples are provided, such as an apparatus including: an omni input adapted to receive digital samples representative of signals received by an omnidirectional microphone having a first reception profile over a frequency range of interest; a directional input adapted to receive digital samples representative of signals received by a directional microphone having a second reception profile over the frequency range of interest; a mixing module connected to the omni input, the mixing module providing a mixing ratio for a block of digital samples, $\alpha(k)$; a compensation filter connected to the directional input and the mixing module, the compensation filter adapted to output a third reception profile which substantially matches the first reception profile; a first multiplier receiving the omni input and a value of $(1-\alpha(k))$ from the mixing module; a second multiplier receiving the directional input and a value of $\alpha(k)$ from the mixing module; and a summing stage adding outputs of the first multiplier and the second multiplier; wherein the output signal for sample n of block k, $s_c(n,k)$, is provided by: $s_c(n,k)=(1-\alpha(k))*s_O(n,k)+\alpha(k)s_D(n,k)$, where $s_O(n,k)$ is the output of the omni microphone for sample n of block k and $s_D(n,k)$ is the output of the compensation filter for sample n of block k, and $\alpha(k)=C*\alpha(k-1)+(1-C)*\beta(k)$, and where C is a constant between 0 and 1 and $\beta(k)$ is an output from the compensation filter for block k.

Some examples provide a power estimation scheme that is reliable against both steady and transient input. It provides examples of a target sound measurement (TSM) estimation scheme that is effective and efficient both in terms of storage size and computational efficiency. The examples employing a decision tree provide a weight factor between the omnidirectional and compensated directional signal. The resulting decision logic improves speech intelligibility when talking under noisy conditions. The decision logic also improves listening comfort when exposed to noise.

This Summary is an overview of some of the teachings of the present application and not intended to be an exclusive or exhaustive treatment of the present subject matter. Further details about the present subject matter are found in the detailed description and appended claims. Other aspects will be apparent to persons skilled in the art upon reading and understanding the following detailed description and viewing the drawings that form a part thereof, each of which are not to be taken in a limiting sense. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present subject matter relates to methods and apparatus for automatic reception enhancement in hearing assistance devices.

The method and apparatus set forth herein are demonstrative of the principles of the invention, and it is understood that other method and apparatus are possible using the principles described herein.

Figure 1:
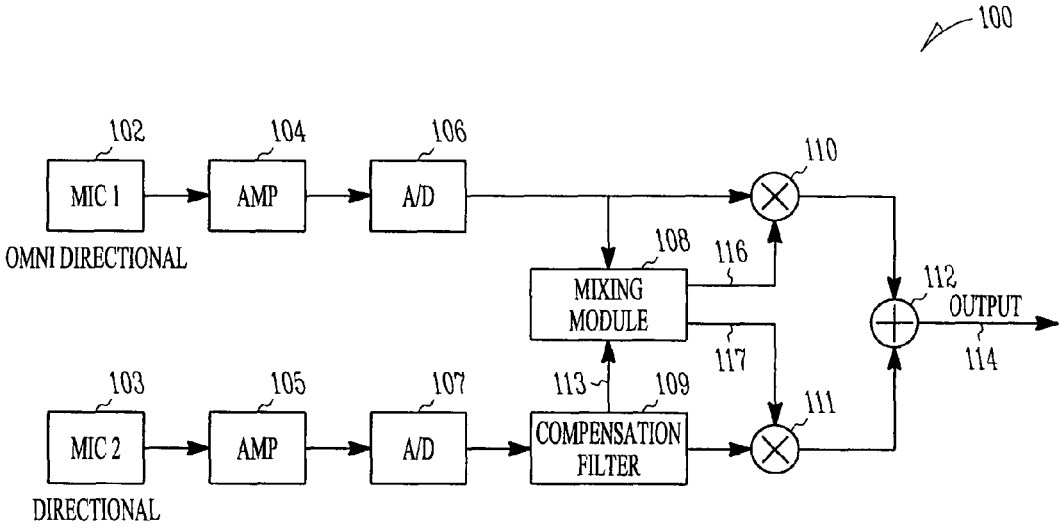
FIG. 1 shows a basic block diagram of the present system, according to one embodiment of the present subject matter.

FIG. 1 shows a basic block diagram of the present system 100, according to one embodiment of the present subject matter. Mic 1 102 is an omnidirectional microphone connected to amplifier 104 which provides signals to analog-to-digital converter 106. The sampled signals are sent to mixing module 108 and multiplier 110. Mic 1 103 is a directional microphone connected to amplifier 105 which provides signals to analog-to-digital converter 107. The sampled signals are sent to compensation filter 109 which processes the signal for multiplier 111. The mixing module generates mixing ratios and presents them on lines 116 and 117 to multipliers 110 and 111, respectively. The outputs of multipliers 110 and 111 are summed by summer 112 and output.

The compensation filter 109 is designed to substantially match the response profile of mic 2 to that of mic 1 on a KEMAR manikin when the sound is coming from zero degree azimuth and zero degree elevation. In so doing, this makes the signal 113 sent to mixing module 108 calibrated for response profile so that mixing module 108 can fairly mix the inputs from both the directional mic 103 and omnidirectional mic 102. More importantly, the mixing module can make decision based on the directional signal with a known frequency characteristics. The output of analog-to-digital convertor 106 is $s_O(n,k)$ and the output 116 from mixing module 108 is characterized as $(1-\alpha(k))$, where $\alpha(k)=C*\alpha(k-1)+(1-C)*\beta(k)$, and where C is a constant between 0 and 1 and $\beta(k)$ is an output from the instantaneous mode value for block k. When the device is in the omnidirectional mode, $\beta(k)$ has a value of 0. When the device is in the directional mode, $\beta(k)$ has a value of 1.

The output from compensation filter 109 is $s_D(n,k)$ and the output 117 of the mixing module 108 is $\alpha(k)$. Thus, the output signal 114 for sample n of block k, $s_c(n,k)$, is provided by:

$$s_c(n,k)=(1-\alpha(k))*s_O(n,k)+\alpha(k)s_D(n,k),$$

where $s_O(n,k)$ is the output of the omni microphone for sample n of block k and $s_D(n,k)$ is the output of the compensation filter 109 for sample n of block k, and $\alpha(k)=C*\alpha(k-1)+(1-C)*P(k)$, and where C is a constant between 0 and 1 $\beta(k)$ is an output from the instantaneous mode value for block k. When the device is in the omnidirectional mode, $\beta(k)$ has a value of 0. When the device is in the directional mode, $\beta(k)$ has a value of 1. The value of C is chosen to provide a seamless transition between omnidirectional and directional inputs. Common values of C include, but are not limited to a value corresponding to a time constant of three seconds.

Figure 2:
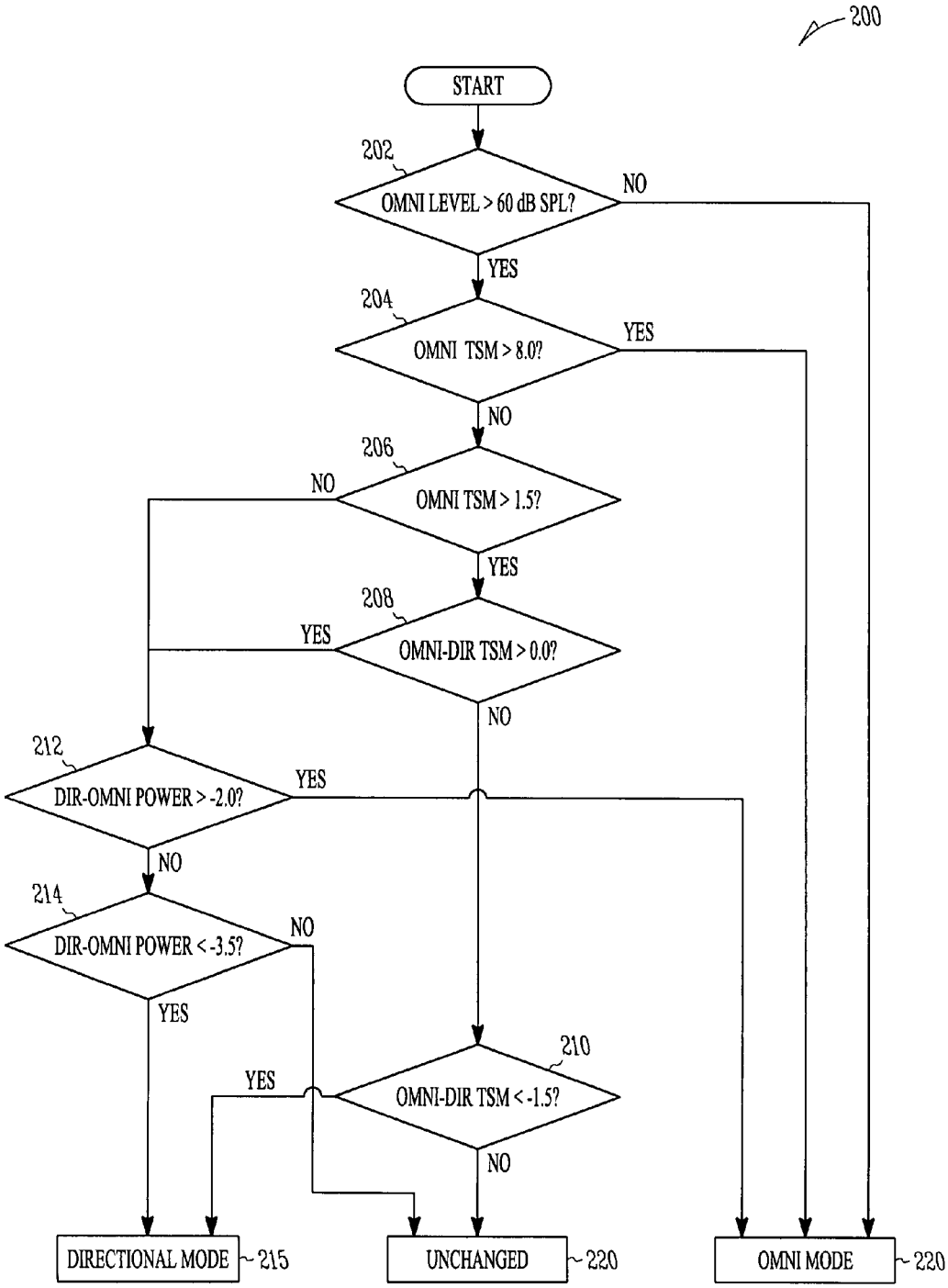
FIG. 2 is a decision tree showing mode selections based on conditions, according to various embodiments of the present subject matter.

FIG. 2 is a decision tree showing mode selections based on conditions, according to one embodiment of the present subject matter. The decision tree provides the $\beta(k)$ value based on the input signals for each block. The switching weight factor, $\alpha(k)$, is a smoothed version of $\beta(k)$ value.

Target sound measurements (TSMs) are used in the decision tree for deciding which mode to select. TSMs are generated from histogram data representing the number of samples in any given signal level. The average signal level $S_O$ is produced by a running average of the histogram data. A noise floor level is found at position $S_N$, of the histogram, which is the sound level associated with a the lowest peak in the histogram. Thus, the TSM is calculated as:

$$TSM=S_O-S_N.$$

Power measurements are provided by the equation:

$$P(n)=$$

$$(1-\alpha)*P(n-1)+\alpha*E(n), \text{ if } E(n)<T \text{ or}$$

$$(1-\alpha)*P(n-1)+\alpha*T, \text{ if } E(n)>T \text{ and } E(n)>E(n-1),$$

Wherein T=a predetermined threshold. E(n) is the instantaneous power of the high-pass filtered input signal. The filter is designed to reduce the contribution of low frequency content to the power estimation.

This nonlinear equation for power provides a reliable estimate of the power for both steady and transient sounds. As a result, it helps improve the switching reliability and ensure that switching between modes does not overly fluctuate. Thus, T is set to reduce sudden changes in the power estimation.

FIG. 2 is intended to demonstrate the subject matter without being limiting or exclusive. The decision process according to such embodiments is as follows. The omni microphone input is tested to see if the current sound is relatively weak or strong 202. In one embodiment a sound level in excess of 60 dB SPL is characterized as strong and the flow proceeds to block 204. If the signal is weak, the device proceeds to block 216 to remain in omni mode.

At block 204, the current TSM of the omni microphone is tested to get a sense of whether the input sound is not random and not a simple sinusoid. If it is determined that the target signal is strong (e.g., speech), then the system deems the omni adequate to receive signals and flow goes to block 216. If the signal is not particularly strong, then the flow goes to block 206. In one embodiment, the omni TSM is tested to see if it exceeds 8.0.

At block 206, the system attempts to decide if the omni signal is close to that of the noise level. If the omni signal is stronger than the noise level, then flow proceeds to block 208. If not, then the flow proceeds to block 212. In one embodiment, the omni TSM is tested to see if it exceeds 1.5 before branching to block 208.

At block 208 the system detects whether the omni provides a better signal. If not the flow goes to block 210, where if it is determined that the directional is better source than the omni, the device enters a directional mode 215. If not, the device does not change modes 220. If the omni does provide a better signal at block 208, then the system attempts to determine whether the omni signal is quieter, and if so goes into omni mode 216. If not, the control goes to block 214. In one embodiment, the test at block 208 is whether the TSM of the difference between omni and directional signals is greater than 0.0. In one embodiment, the test at block 210 is whether that TSM difference is less than −1.5.

If the test of block 208 is positive, then the flow transfers to block 212, where it is determined if the power of the directional is greater than the power of the omni. If so, the device enters the omni mode 216, since it is a noisy environment and the system is selecting the quieter of the two. If not, control transfers to block 214. In one embodiment, the test at block 212 is whether the power of the directional signal exceeds that of the omni by more than −2.0.

At block 214, the system determines whether directional is quieter than the omni. If so, the system enters directional mode 215. If not, the system does not change modes 220. In one embodiment, the difference of the directional and omni powers is measured and if less than −3.5, then it branches to the directional mode 215.

It is understood that values and exact order of the forgoing acts can vary without departing from the scope of the present application and that the example set forth herein is intended to demonstrate the principles provided herein.

Figure 3:
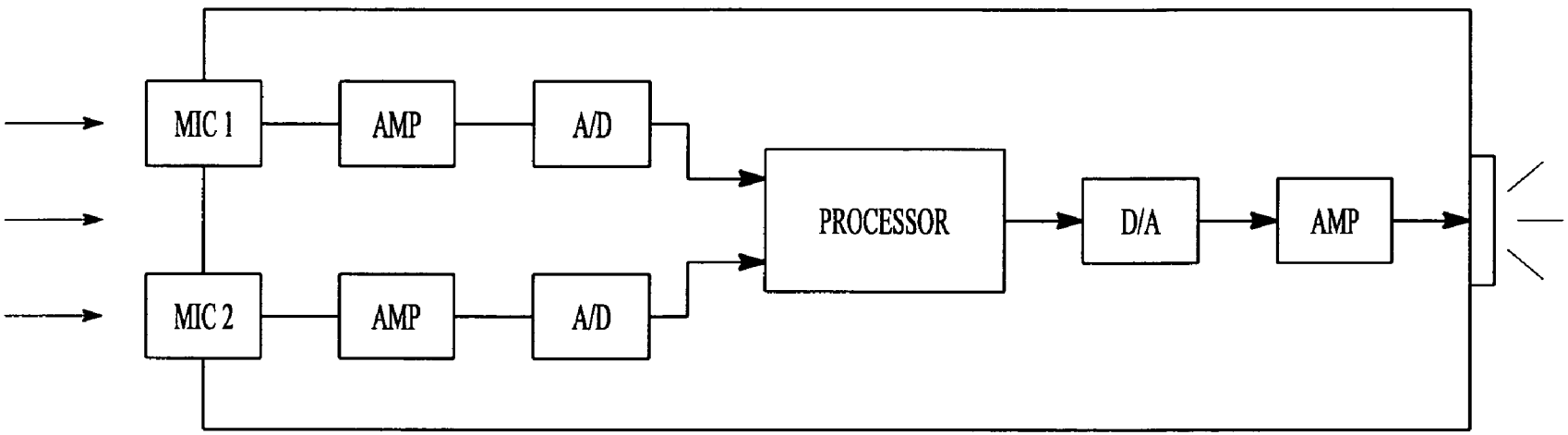
FIG. 3 is a block diagram of a hearing assistance device, incorporating the teachings of the present subject matter according to one embodiment of the present subject matter.

FIG. 3 is a block diagram of a hearing assistance device, incorporating the teachings of the present subject matter according to one embodiment of the present subject matter. In applications, such as hearing assistance devices, the processing can be done by a processor. In one embodiment, the processor is a digital signal processor. In one embodiment, the processor is a microprocessor. Other processors may be used and other component configurations may be realized without departing from the principles set forth herein. Furthermore, in various embodiments, the operations may be distributed in varying combinations of hardware, firmware, and software.

Figure 4:
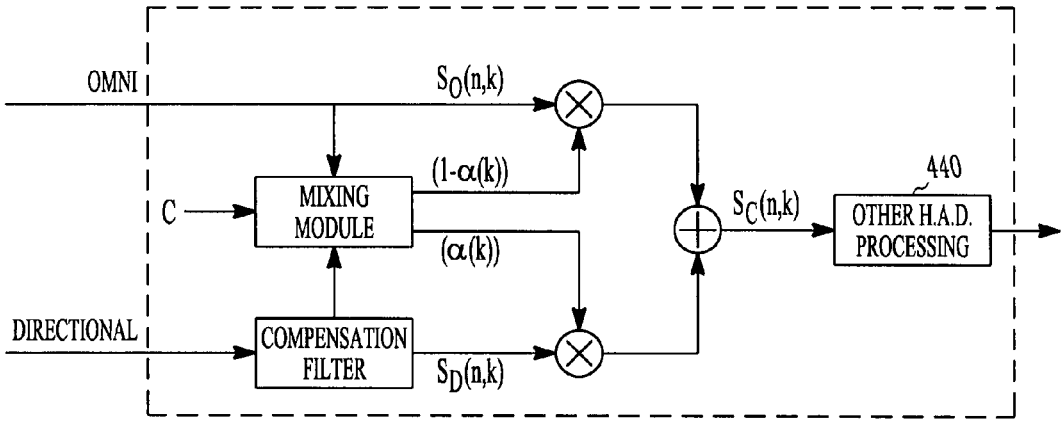
FIG. 4 is a block diagram of a signal process flow in the processor of FIG. 3 according to one embodiment of the present subject matter.

FIG. 4 is a block diagram of a signal process flow in the processor of FIG. 3 according to one embodiment of the present subject matter. As demonstrated by FIG. 4, the processor can perform additional process functions on the output. For example, in the case of a hearing aid, other hearing assistance device processing 440, includes hearing aid processes and can be done on the output signal. Such processing may be performed by the same processor as shown in FIG. 3 or by combinations of processors. Thus, the system is highly programmable and realizable in various hardware, software, and firmware realizations.

The present subject matter provides compensation for a directional signal to work with the given algorithms. It provides a power estimation scheme that is reliable against both steady and transient input. It provides a TSM estimation scheme that is effective and efficient both in terms of storage size and computational efficiency. The embodiments employing a decision tree provide a weight factor between the omnidirectional and compensated directional signal. The resulting decision logic improves speech intelligibility when talking under noisy conditions. The decision logic also improves listening comfort when exposed to noise.

It is further understood that the principles set forth herein can be applied to a variety of hearing assistance devices, including, but not limited to occluding and non-occluding applications. Some types of hearing assistance devices which may benefit from the principles set forth herein include, but are not limited to, behind-the-ear devices, on-the-ear devices, and in-the-ear devices, such as in-the-canal and/or completely-in-the-canal hearing assistance devices. Other applications beyond those listed herein are contemplated as well.

This application is intended to cover adaptations or variations of the present subject matter. It is to be understood that the above description is intended to be illustrative, and not restrictive. Thus, the scope of the present subject matter is determined by the appended claims and their legal equivalents.

What is claimed is:

1. An apparatus, comprising:

an omnidirectional microphone having a first reception profile;

a directional microphone having a second reception profile;

an omni input adapted to receive digital samples representative of signals received by the omnidirectional microphone;

a directional input adapted to receive digital samples representative of signals received by the directional microphone;

a mixing module connected to the omni input, the mixing module providing a mixing ratio for a block of digital samples, $\alpha(k)$;

a compensation filter connected to the directional input and the mixing module, the compensation filter adapted to output a third reception profile which substantially matches the first reception profile;

a first multiplier receiving the omni input and a signal value of $(1-\alpha(k))$ from the mixing module;

a second multiplier receiving the directional input and a signal value of $\alpha(k)$ from the mixing module; and a summing stage adding outputs of the first multiplier and the second multiplier, wherein the output signal for sample n of block k, $s_c(n,k)$, is provided by:

$$s_c(n,k)=(1-\alpha(k))*s_O(n,k)+\alpha(k)s_D(n,k),$$

where $s_O(n,k)$ is the output of the omni microphone for sample n of block k and $s_D(n,k)$ is the output of the compensation filter for sample n of block k, and $\alpha(k)=C*\alpha(k-1)+(1-C)*\beta(k)$, and where C is a constant between 0 and 1 and $\beta(k)$ is an output from the compensation filter for block k.

2. The apparatus of claim 1, further comprising hearing assistance device processing, and wherein the output signal, $s_c(n,k)$, is processed by the hearing assistance device processing.

3. The apparatus of claim 2, wherein the hearing assistance device processing is realized in a combination of processors.

4. The apparatus of claim 2, wherein the hearing assistance device processing is realized in a processor.

5. The apparatus of claim 2, wherein the hearing assistance device processing is realized in hardware, software and firmware.

6. The apparatus of claim 2, wherein the apparatus is used in a behind-the-ear hearing assistance device.

7. The apparatus of claim 2, wherein the apparatus is used in an on-the-ear hearing assistance device.

8. The apparatus of claim 2, wherein the apparatus is used in an in-the-ear hearing assistance device.

9. The apparatus of claim 2, wherein the apparatus is used in an in-the-canal hearing assistance device.

10. The apparatus of claim 2, wherein the apparatus is used in a completely-in-the-canal hearing assistance device.

11. A method, comprising:

sampling an omni signal representative of signals received by an omnidirectional microphone;

sampling a directional signal representative of signals received by a directional microphone;

comparing the omni signal to a predetermined sound level, and entering an omnidirectional mode if the omni signal does not exceed the predetermined sound level;

if the omni signal exceeds the predetermined sound level, performing an omni target sound measurement (TSM) derived at least in part from a difference of an average signal level for the omni signal and a noise floor level for the omni signal;

comparing the omni TSM to a first predetermined TSM threshold;

entering the omnidirectional mode if the omni TSM exceeds the first predetermined threshold, else determining if the omni TSM is above the noise floor level;

if the omni TSM is above the noise floor level, comparing a power of the directional signal to a power of the omni signal to enter the omnidirectional mode if a first predetermined difference is satisfied and enter the directional mode if a second predetermined difference is satisfied; and if the omni TSM is not above the noise floor level, determining if the omni signal is a better signal than the directional signal, and if the omni signal is not determined to be a better signal than the directional signal, determining if the directional signal is a better signal than the omni signal, and entering the directional mode if the directional signal is better than the omni signal, and if the omni signal is determined to be a better signal than the directional signal, comparing the power of the directional signal to the power of the omni signal to enter the omnidirectional mode if the first predetermined difference is satisfied and enter the directional mode if the second predetermined difference is satisfied.

12. The method of claim 11, wherein the predetermined sound level is approximately 60 dB of sound pressure.

13. The method of claim 11, wherein the first predetermined TSM threshold is approximately 8.

14. The method of claim 11, wherein the noise floor level is approximately 1.5.

15. The method of claim 11, wherein the first predetermined difference is provided by: direct power−omni power>−2.0.

16. The method of claim 11, wherein the second predetermined difference is provided by: direct power−omni power>−3.5.

17. The method of claim 11, wherein determining if the omni signal is a better signal than the directional signal includes determining if the TSM of a difference between omni and directional signals is greater than 0.0, and determining if the directional signal is a better signal than the omni signal includes determining if the TSM of a difference between omni and directional signals is less than −1.5.

18. A system, comprising:

means for sampling an omni signal representative of signals received by an omnidirectional microphone, and a directional signal representative of signals received by a directional microphone;

means for entering an omnidirectional mode if the omni signal does not exceed a predetermined sound level, and performing an omni target sound measurement (TSM) derived at least in part from a difference of an average signal level for the omni signal and a noise floor level for the omni signal if the omni signal exceeds the predetermined sound level;

means for entering the omnidirectional mode if the omni TSM exceeds a first predetermined threshold, and determining if the omni TSM is above the noise floor level if the omni TSM doe not exceed the first predetermined threshold; and means for, if the omni TSM is above the noise floor level, entering the omnidirectional mode if a first predetermined difference in powers between the directional signal and omni signal is satisfied, and entering the directional mode if a second predetermined difference in powers between the directional signal and omni signal is satisfied.

19. The system of claim 18, further comprising means for, if the omni TSM is not above the noise floor level, determining if the directional signal is a better signal than the omni signal, and entering the directional mode if the directional signal is better than the omni signal if the omni signal is not determined to be a better signal than the directional signal.

20. The system of claim 18, wherein the system is used in device selected from a group of devices consisting of: a behind-the-ear hearing assistance device, an on-the-ear hearing assistance device, an in-the-ear hearing assistance device, an in-the-canal hearing assistance device, and a completely-in-the-canal hearing assistance device.

* * * * *

UNITED STATES PATENT AND TRADEMARK OFFICE

CERTIFICATE OF CORRECTION

PATENT NO. : 8,068,627 B2
APPLICATION NO. : 11/686275
DATED : November 29, 2011
INVENTOR(S) : Tao Zhang et al.

It is certified that error appears in the above-identified patent and that said Letters Patent is hereby corrected as shown below:

In column 8, line 11, in Claim 18, delete "doe" and insert -- does --, therefor.

Signed and Sealed this
Thirteenth Day of March, 2012

David J. Kappos

David J. Kappos
*Director of the United States Patent and Trademark Office*